US006708976B2

(12) United States Patent
Cho

(10) Patent No.: US 6,708,976 B2
(45) Date of Patent: Mar. 23, 2004

(54) DART BOARD

(76) Inventor: Yu-Fu Cho, P.O. Box 15-180, Taichung (TW)

( * ) Notice: Subject to any disclaimer, the term of this patent is extended or adjusted under 35 U.S.C. 154(b) by 0 days.

(21) Appl. No.: 10/173,438

(22) Filed: Jun. 18, 2002

(65) Prior Publication Data

US 2002/0195777 A1 Dec. 26, 2002

(51) Int. Cl.[7] ..... F41J 5/04
(52) U.S. Cl. ..... 273/374; 273/408
(58) Field of Search ..... 273/371–377, 273/403, 408

(56) References Cited

U.S. PATENT DOCUMENTS 4,057,251 A * 11/1977 Jones et al. ..... 273/376
4,561,660 A * 12/1985 Zammuto ..... 273/376
5,505,459 A * 4/1996 Yiu ..... 273/408
5,518,250 A * 5/1996 Lu et al. ..... 273/348.5
5,848,792 A * 12/1998 Brejcha ..... 273/376

* cited by examiner

*Primary Examiner*—Mark S. Graham

(57) ABSTRACT

A dart board includes at least one flexible slot which includes at least two apertures for receiving the dart tips. A through hole is defined between the two apertures so as to expand the flexible slot and the dart tips having different sizes can be clamped by the flexible aperture. A guide plate is fixed to the retaining frame so as to guide the dart tips to successfully stick on the dart board and activate the electronic film switches of the dart board. The size of the retaining frame can be reduced because of the fixed guide plate. The guide plate and the retaining frame are engaged by engaging members and engaging holes so that the guide plate can be easily replaced. The guide plate can be fixed to the retaining frame.

4 Claims, 8 Drawing Sheets

DART BOARD

FIELD OF THE INVENTION

The present invention relates to a dart board that includes at least a target block and each target block has at least one flexible slot which includes at least two apertures which may receive a dart tip with different sizes. A through hole is defined between the at least two apertures so that the darts having different sizes can be clamped by the flexible slot. A dart board that includes at least one target block and each target block has at least one flexible aperture and each flexible aperture has at least one through hole. A fixed guide plate is engaged with the frame to guide the dart tips into the apertures.

BACKGROUND OF THE INVENTION

A conventional dart board generally includes a backing with frame on the back and target blocks are engaged with the partitions defined by the longitudinal and altitude, frames of the frame. The target blocks have comb-shaped apertures which have a fixed size so as to receive the dart tips that are accompanied with the dart board when purchased. However, the sizes of the apertures are fixed so that the customers cannot find suitable darts in the market except the original manufacturers. The darts often drop from the dart board if the darts do not fit the apertures and this make the scoring difficult. The dart tips could be damaged or broken when hitting the ground. The target blocks of a conventional electronic dart board are slidable so that the dart cannot stick on the target block if the dart hits on the target a block at angle. These shortcomings exist for the electronic dart boards. The target blocks and/or the surface plate (if available) are fixed to the backing so that the customers cannot replace them at home.

The present invention intends to provide a dart board wherein the target blocks have flexible apertures and the guide plate can be easily replaced.

SUMMARY OF THE INVENTION

In accordance with one aspect of the present invention, there is provided a target block which has at least one flexible slot which includes at least two apertures which may receive the dart tip. A through hole is defined between the at least two apertures so that the darts having different sizes can be clamped by the flexible slot. A target block has at least one flexible aperture which includes at least one through hole.

The primary object of the present invention is to provide a dart board that has flexible slots or flexible apertures defined in each of the target blocks and each flexible slot includes two apertures so as to receive the dart tips with different sizes. Each flexible aperture has at least one through hole so that the darts having different sizes can be clamped by the flexible aperture. The flexible slot or the flexible apertures have a flexible edge which expands when the darts hit the flexible slot or the flexible apertures, and then properly clamps the darts. After the dart is removed, the flexible slot or the flexible aperture come back to their original size. The invention increases the convenience of use for the darts with different sizes.

Another object of the present invention is to provide a dart board that has a guide plate which has guide apertures for guiding the dart tips and the guide plate is easily to replaced. In order to conveniently and quickly position the guide plate, the retaining frame has at least one protruding engaging member or hole for being engaged with the hooks, rods or plates on the guide plate. This makes the guide plate fixed and saves the cost of machining. The hooks, rods or plates allow the guide plate to be replaced easily. The retaining frame has at least one reinforcement plate or the reinforcement plate is made with the retaining frame as one-piece member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
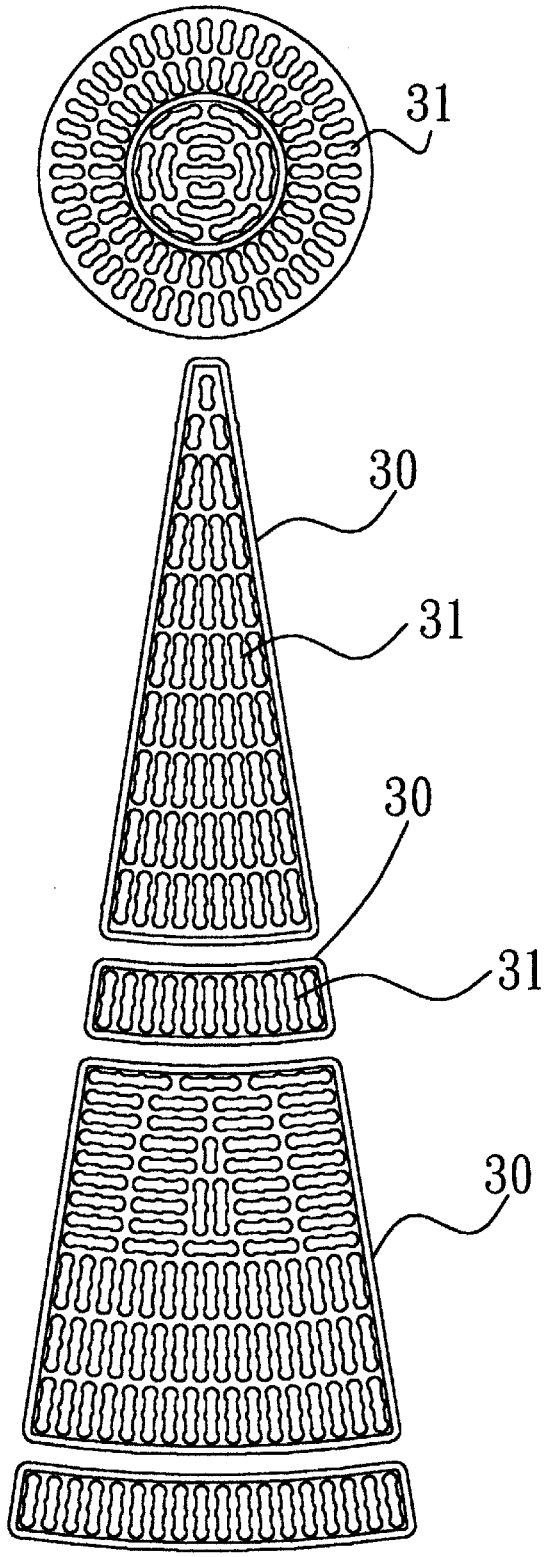
FIG. 1 shows the dart block of the dart board of the present invention.

Referring to FIG. 1 which shows the front view of the flexible slot 31 of the target block 30.

Figure 2:
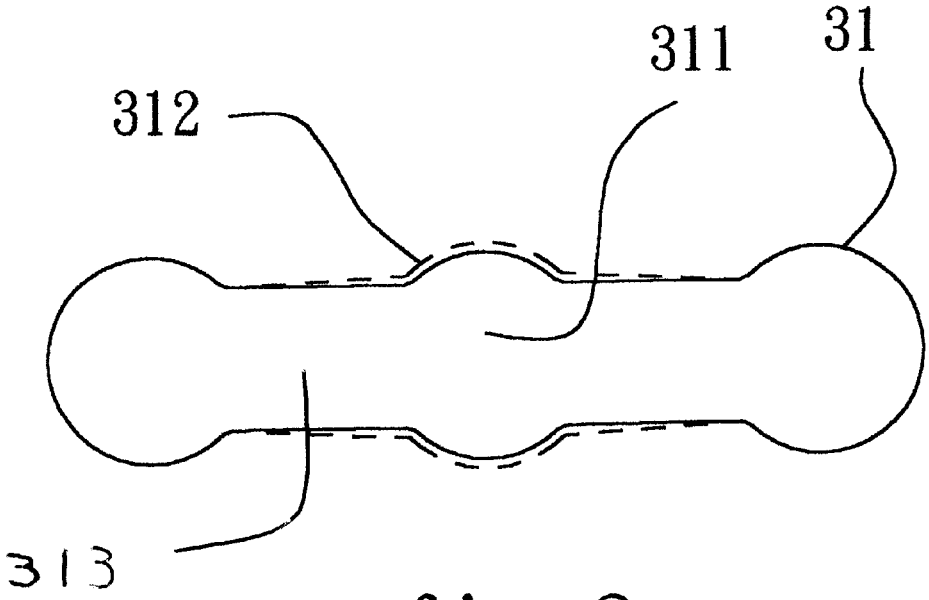
FIG. 2 shows the through hole located between the two apertures of the flexible slot is expandable.

Referring to FIG. 2 which shows that the flexible slots 31 of the target block 30 has at least two flexible apertures 311 so as to clamp the darts 20. The through hole 313 is located an edge of the flexible aperture 311 so as to form an opening which makes the flexible aperture 311 to be expandable and shrinkable.

Figure 3:
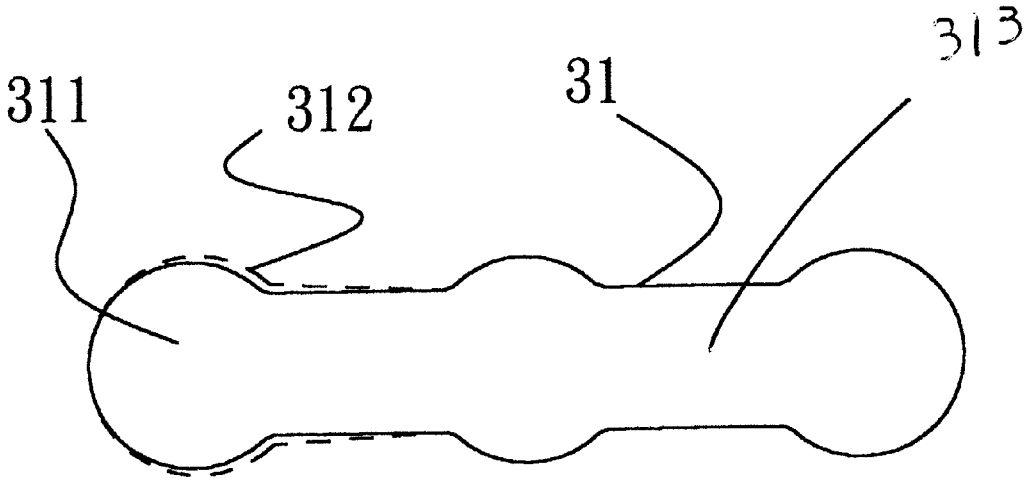
FIG. 3 shows the two apertures of the flexible slot are expandable.

Further referring to FIG. 3, the target block 30 of the present invention has flexible slots 31 and the dart 20 penetrates the flexible aperture 311 of the flexible slot 31. When the of the dart tip is a larger one, the flexible aperture 31 may expand instantly to form a deformed aperture 312 as in dotted lines and clamp the dart tip 20. After the dart is removed from the target block 30, the deformed aperture 312 shrinks back to the aperture 311 with original size.

Figure 4:
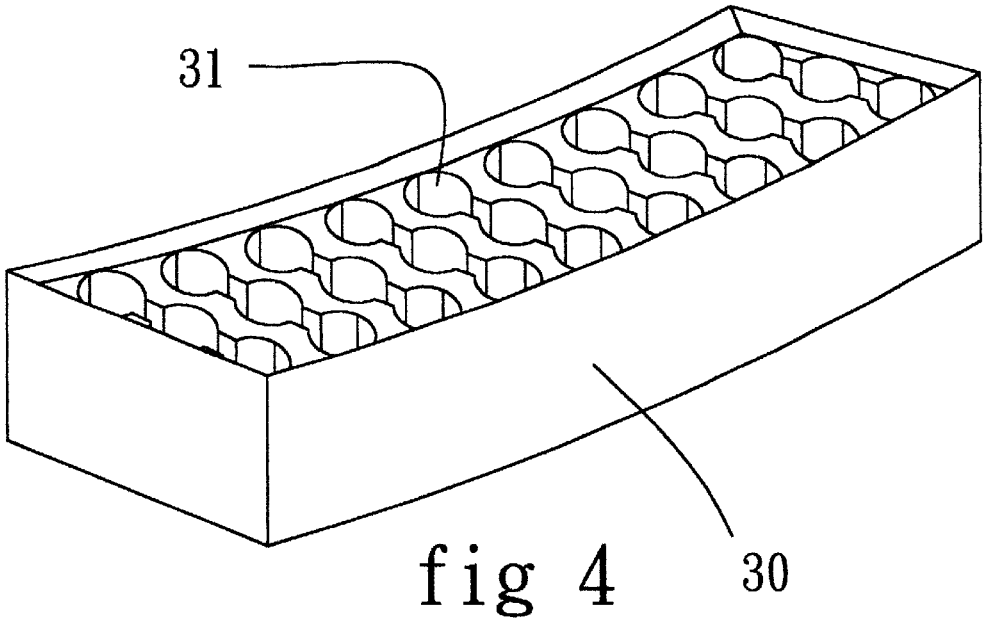
FIG. 4 shows target block of the dart board of the present invention.

Referring to FIG. 4 which shows the exploded view of the flexible slot 31 of the target block 30.

Figure 5:
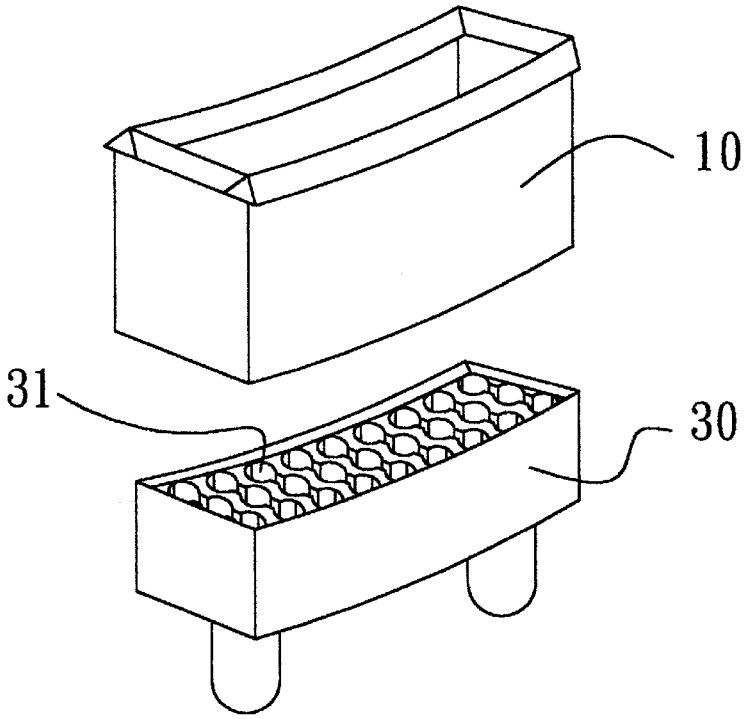
FIG. 5 is an exploded view to show the target block of the dart board of the present invention.

Referring to FIG. 5 which shows the exploded view of the retaining frame 10 and the target block 30.

Figure 6:
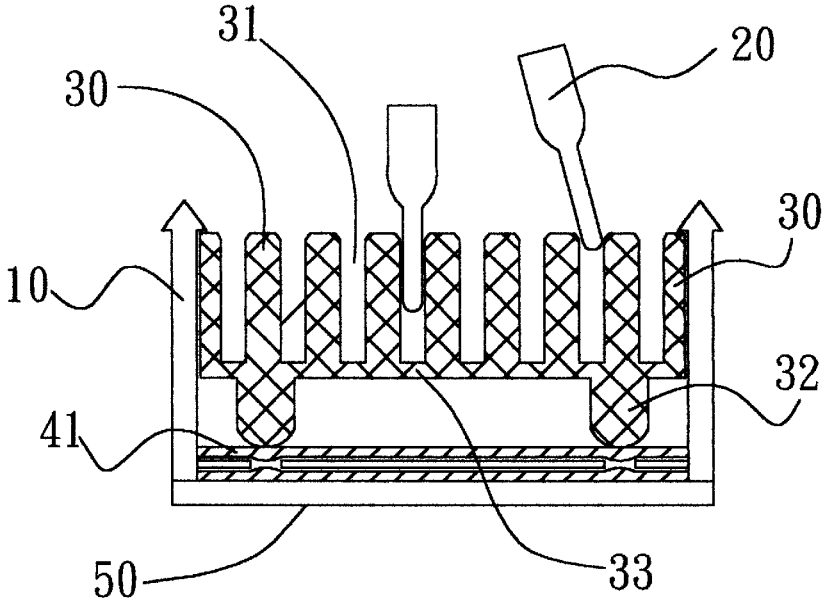
FIG. 6 shows dart tips are inserted in the target block of the present invention.

Referring to FIG. 6 which shows the target block 30 of the present invention and the target block 30 is received in the retaining frame 10. A bottom plate 33 is connected to an underside of the flexible slot 31 so as to control the depth of the darts 20 in the flexible slot 31 and to prevent the dart tip 20 from being stocked in the flexible aperture 311. The target block 30 has protrusions 32 to contact the electronic film switches 41 so as to allow the CPU to show the result of the game by various types of automatic scoring devices by light, sound, music, LED, LCD, and back-light board.

Figure 7:
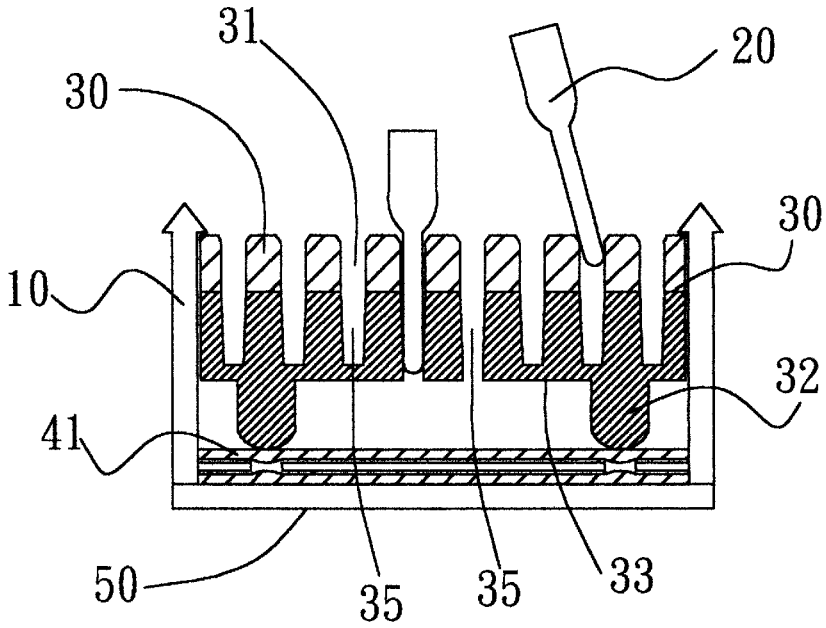
FIG. 7 shows an insertion aperture is defined in the target block of the dart board of the present invention.

Referring to FIG. 7 the flexible aperture 311 communicates with an insertion hole 35 which is located deep in the target block 30 and has a fixed size so that when the dart tip 20 penetrates the flexible slot 31, the flexible slot 31 expands to accommodate the dart tip 20 and the insertion hole 35 having the fixed size secures the dart tip. The bottom plate 33 is located at the underside of the insertion hole 35 so as to control the depth of the darts 20 in the target block 30. The bottom plate 33 may be omitted and the insertion hole 35 is made to be a through hole. The target block 30 has protrusions 32 on the back thereof so as to contact the electronic film switches 41 and to allow the CPU proceed different ways of automatic scoring to display the scores.

Figure 8:
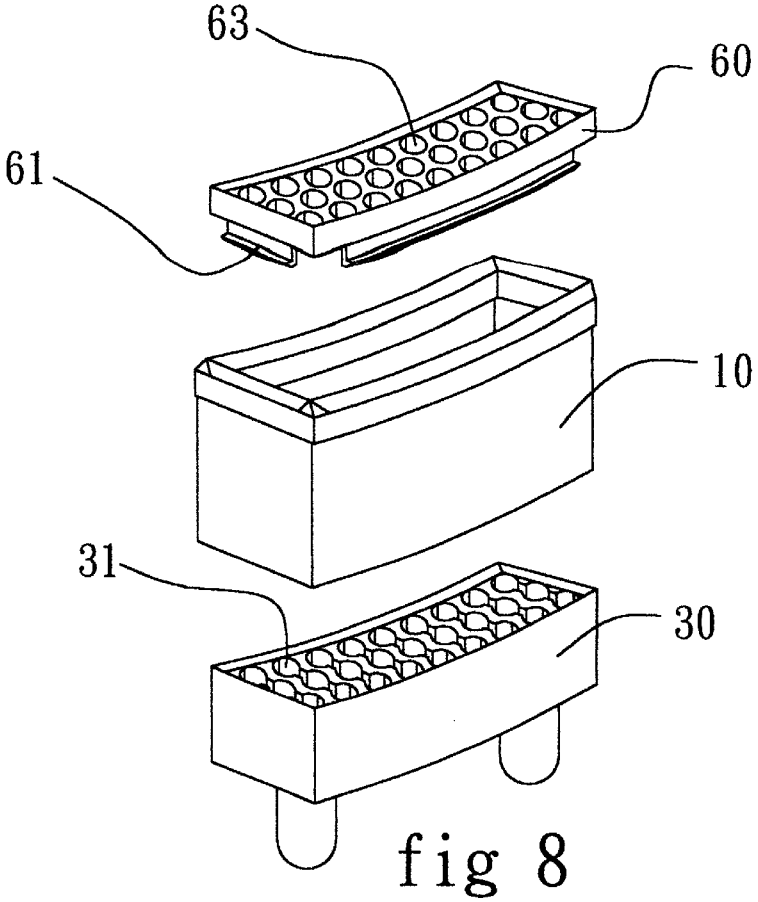
FIG. 8 is an exploded view to show another embodiment of the target block of the dart board of the present invention.
Figure 9:
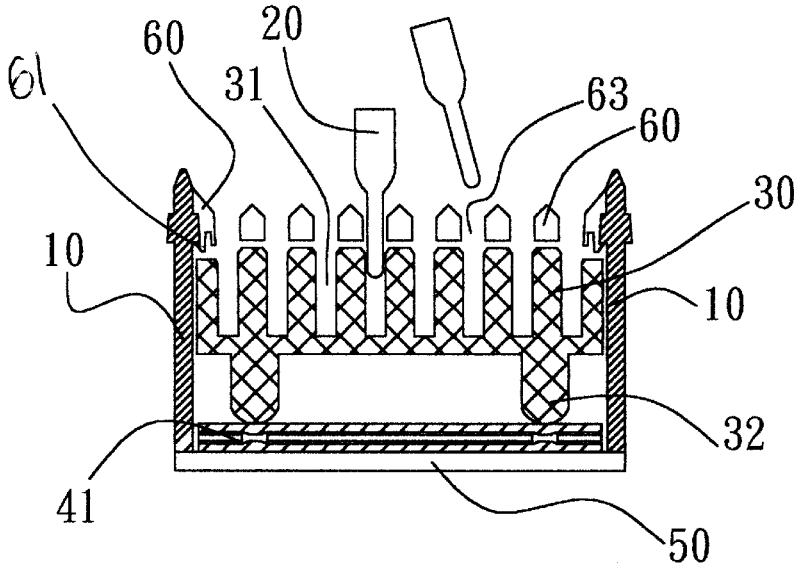
FIG. 9 shows dart tips are inserted in the target block as shown in FIG. 8.

Referring to FIGS. 8 and 9, the target block 30 is received in the retaining frame 10 and includes flexible slots 31 defined therein. Two protrusions 32 extend from a bottom plate of the target block 30. A guide plate 60 is engaged with the retaining frame 10 and includes a plurality of guide apertures 63. The guide apertures 63 are used for guiding the dart 20 to penetrate the flexible aperture 311 of the target block 30. At least one engaging member 61 extends from the guide plate 60 so as to be engaged with an inside of the retaining frame 10.

Figure 10:
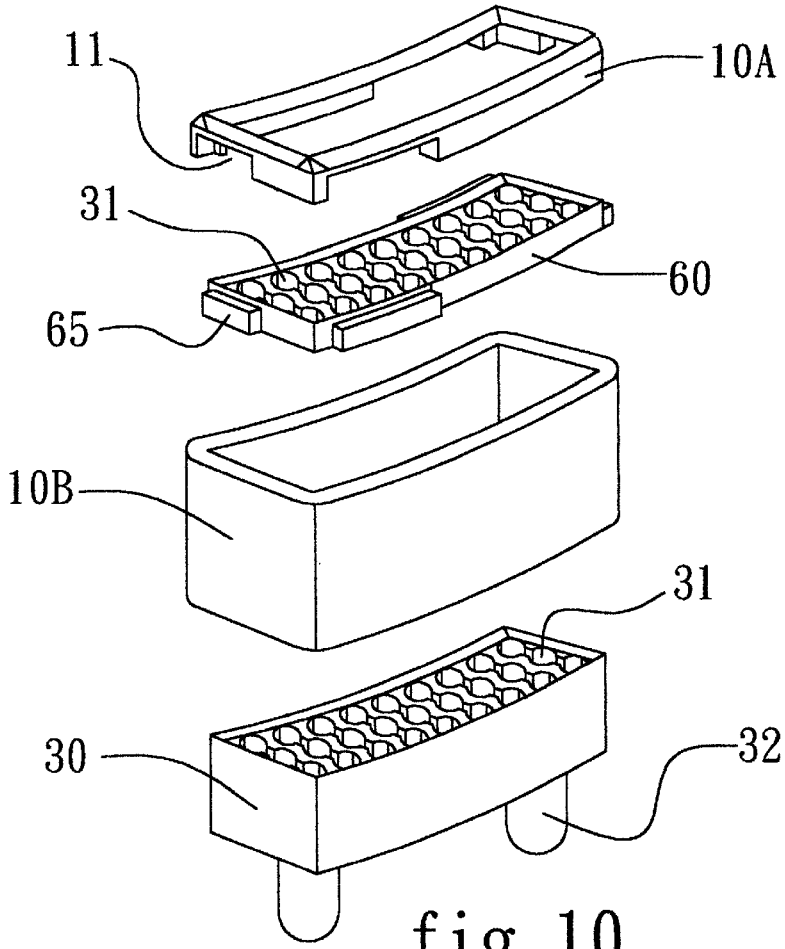
FIG. 10 is an exploded view to show yet another embodiment of the target block of the dart board of the present invention.
Figure 11:
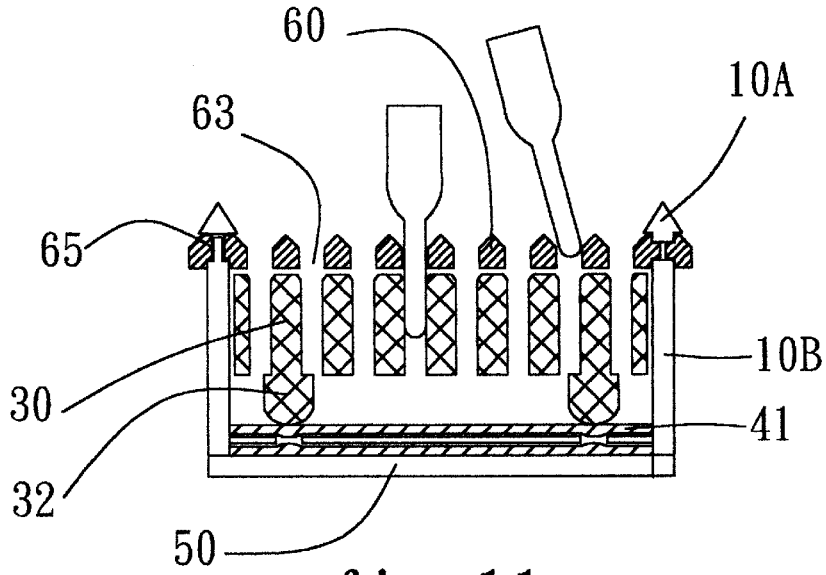
FIG. 11 shows dart tips are inserted in the target block as shown in FIG. 10.
Figure 12:
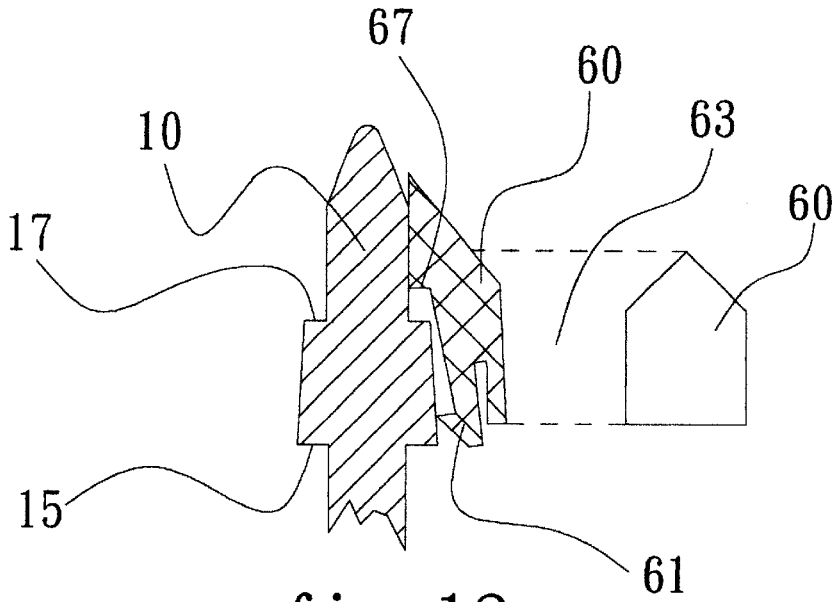
FIG. 12 shows a further way of engagement between the guide plate and the retaining frame.
Figure 13:
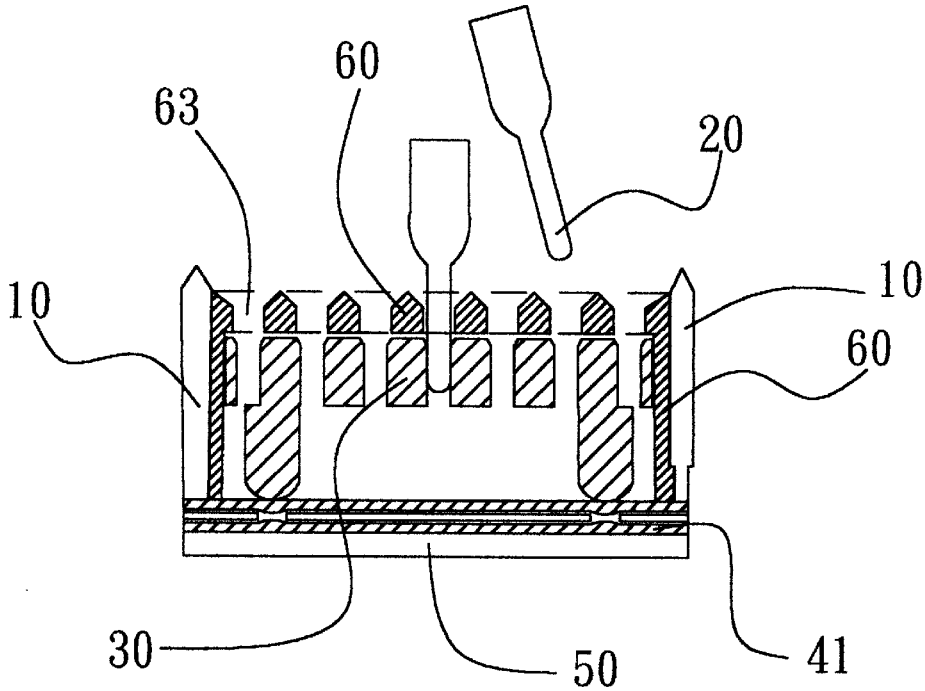
FIG. 13 shows the guide plate has extensions contacting against the backing.

FIGS. 10 and 11, the retaining frame 10 can be composed of a main portion 10B and a top portion 10A which is mounted to the top of the main portion 10B and includes recesses 11 defined in sides thereof. The guide plate 60 has engaging members 65 extending therefrom which are engaged with the recesses 11 of the top portion 10A . The guide apertures 63 of the guide plate 60 can be made as the flexible apertures 311. The retaining frame 10 can be at least one layer or multiple layers. When fixing the multiple layers of the retaining frames 10, known methods for fixing such as screwing, clamping, inserting, snapping, gluing, or heat fusion can also be used besides the fixing way of the present invention. FIG. 12 shows that the guide plate 60 may have hooks 61 and 67 which are engaged with the engaging protrusions 15, 17 extending from the retaining frame 10. FIG. 13 shows that the guide plate 60 has extensions which extend and push against the backing 50 so that the guide plate 60 is not slidable when the darts 20 hit the dart board.

Figure 14:
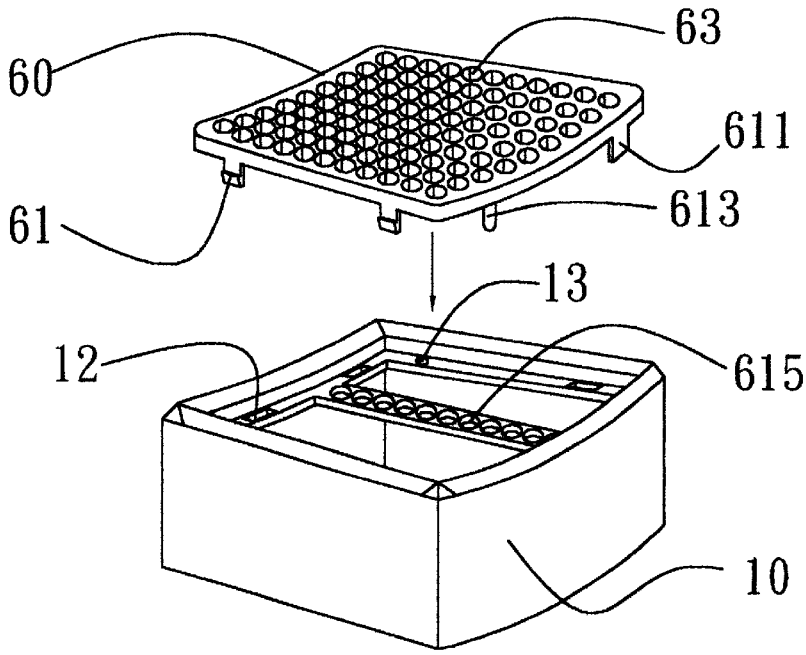
FIG. 14 shows the retaining frame has a reinforcement plate to reinforce the guide plate.

FIG. 14 shows the retaining frame 10 includes flanges extending inward from four insides thereof and each flange has holes 12 and 13. A reinforcement plate 615 is connected between two opposite flanges and the guide plate 60 having guide apertures 63 is engaged with the retaining frame 10. The reinforcement plate 615 reinforces the ability of striking for the guide plate 60 fixed on the retaining frame 10, also reinforces the structure of the retaining frame 10. A plurality of insertions 61, 611, 613 extend from the guide plate 60 so as to be engaged with the holes 12, 13 in the flanges. The reinforcement plate 615 can replace the guide plate 60 or the guide plate 60 can be made with the retaining frame 10 as a one-piece member.

The connection of the guide plate 60 and the retaining frame 10 can also be other known methods such as screwing, clamping, inserting, snapping, gluing, or heat fusion, besides the fixing way of the present invention.

Figure 15:
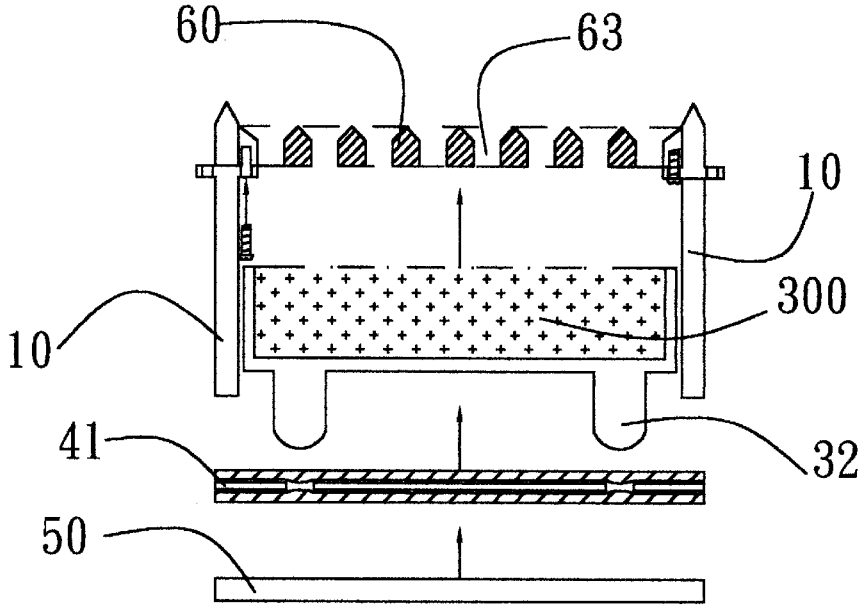
FIG. 15 shows a soft material received in the target block.

FIG. 15 shows that a soft stuff member 300 is received in the target block and supported by the bottom plate. The soft stuff member 300 is made of artificial or chemical fibers, plant fibers, hays, paper, rubber, polyester, plastic or any known material which allows the dart tip to penetrate therein. The guide aperture 63 of the guide plate 60 can be made as the flexible aperture 311. A spring or resilient member can also be installed between the guide plate 60 and the inside of the retaining frame 10 so as to reduce the impact affect to the guide plate 60 by the darts 20.

While we have shown and described the embodiment in accordance with the present invention, it should be clear to those skilled in the art that further embodiments may be made without departing from the scope of the present invention.

What is claimed is:

1. A dart board comprising:

at least one target block and each target block having at least one flexible slot which includes at least two flexible apertures which are adapted to receive the dart tips, a through hole defined between the at least two apertures, the flexible apertures clamping dart tips with different sizes.

2. The dart board as claimed in claim 1, wherein the target block has at least one protrusion to contact electronic film switches.

3. The dart board as claimed in claim 1, wherein a bottom plate is connected to an underside of the at least one flexible slot.

4. The dart board as claimed in claim 1 wherein the flexible slot communicates with the insertion apertures.

* * * * *